US008155799B2

(12) United States Patent
Agrell

(10) Patent No.: US 8,155,799 B2
(45) Date of Patent: Apr. 10, 2012

(54) SAFETY ARRANGEMENT FOR A DISCHARGING SIGNALLING SYSTEM

(75) Inventor: Rikard Agrell, Knivsta (SE)

(73) Assignee: SAAB AB, Linköping (SE)

( * ) Notice: Subject to any disclaimer, the term of this patent is extended or adjusted under 35 U.S.C. 154(b) by 1033 days.

(21) Appl. No.: 12/078,123

(22) Filed: Mar. 27, 2008

(65) Prior Publication Data

US 2008/0255730 A1 Oct. 16, 2008

(30) Foreign Application Priority Data

Mar. 27, 2007 (EP) ..... 07105025

(51) Int. Cl.
*B64D 1/00* (2006.01)
*B64D 1/02* (2006.01)

(52) U.S. Cl. ..... 701/3; 701/45; 244/136

(58) Field of Classification Search ..... 701/3, 45; 244/136

See application file for complete search history.

(56) References Cited

U.S. PATENT DOCUMENTS 3,779,129 A * 12/1973 Lauro ..... 89/1.56
3,797,394 A 3/1974 Thurston et al.
4,154,168 A * 5/1979 Campbell et al. ..... 102/345
4,621,579 A 11/1986 Badura et al.
5,229,538 A * 7/1993 McGlynn et al. ..... 89/1.56
5,430,448 A * 7/1995 Bushman ..... 342/52
5,663,518 A * 9/1997 Widmer ..... 89/1.11
5,773,745 A * 6/1998 Widmer ..... 89/1.11
5,821,447 A * 10/1998 Reams et al. ..... 102/223
6,055,909 A * 5/2000 Sweeny ..... 102/336
6,289,817 B1 * 9/2001 Quebral et al. ..... 102/357
6,584,880 B1 * 7/2003 Pahl et al. ..... 89/1.55
6,662,700 B2 * 12/2003 O'Neill ..... 89/1.11
6,738,012 B1 * 5/2004 Kirkpatrick ..... 342/67
7,284,727 B2 * 10/2007 Nolan ..... 244/136
7,367,531 B2 * 5/2008 Greene ..... 244/195
7,717,356 B2 * 5/2010 Petersen ..... 239/8
7,735,752 B1 * 6/2010 Songer et al. ..... 239/171
7,866,246 B2 * 1/2011 Bellino et al. ..... 89/1.51
2005/0051669 A1 * 3/2005 Heller et al. ..... 244/136

OTHER PUBLICATIONS

European Search Report—Nov. 5, 2007.

* cited by examiner

*Primary Examiner* — Faye M Fleming
*Assistant Examiner* — James English
(74) *Attorney, Agent, or Firm* — Venable LLP; Eric J. Franklin

(57) ABSTRACT

A method and system for allowing unsafe action signals in a dispensing system of a vehicle. A discharging signalling system of at least one dispenser of a vehicle includes an activation circuit arranged to discharge the dispenser. An indicator is arranged to indicate that dispensing is allowed. The activation circuit includes a first safety arrangement arranged to be activated when an indication from the indicator indicates that dispensing is allowed. The activation circuit also includes a second safety arrangement arranged to be activated when a discharge of the dispenser is indicated.

12 Claims, 3 Drawing Sheets

SAFETY ARRANGEMENT FOR A DISCHARGING SIGNALLING SYSTEM

CROSS-REFERENCE TO RELATED APPLICATIONS

This application claims priority to European patent application 07105025.6 filed 27 Mar. 2007.

FIELD OF THE INVENTION

The invention relates to a method for allowing unsafe actions in a vehicle. Specifically, the invention relates to a method and a system for providing a time gap, wherein unsafe action signals are allowed.

BACKGROUND TO THE INVENTION

Today, a large problem in the avionic industry is the safety of counter measure dispensing systems. Counter measure dispensers have been on the market for a long time and are controlled by a dispensing controller. In general the system is software controlled during the entire mission and all static safety signals are set to be true as soon as the vehicle has left the ground. Counter measure dispensers are used to dispense flares/chaffs, depending on what threat, which the pilot can release in order to counter any homing of a missile to the plane. Chaff is tiny strips of aluminium foil and each strip is cut in length to match the various wavelengths of the radar and is effective against nearly all radar threats. Flares are white hot magnesium that are designed to defeat the infra-red (IR) tracking mechanisms of a missile. Pyrotechnical dispensers include a powder charge that ignites the flare and simultaneously creates a positive pressure used to shoot out the flare. The explosion of the powder charge during the ignition as well as the velocity of the flare is unsafe for a person and can do great harm. Other dispensing system may involve dispensers that are used to drop attack measures such as bombs or the like, and also exist in naval vehicles as well as in land vehicles. Previously have accidents been avoided by providing thorough instructions for ground personnel and pilots but the requirements of avoiding unintentional discharge of dispensers have increased. In the systems of today the counter measure dispensers have run the risk of unintentionally discharging from the moment the vehicle has left the ground until the vehicle has landed, due to the discharge cycle being controlled by unclassified software, which has a high probability of making faults. However, solving the safety issue by implementing classified software in the dispensing system is both time consuming and expensive.

In document U.S. Pat. No. 4,154,168 discloses a dispensing system for a naval vehicle. In the system the discharging signal is sent sequentially to different dispensers.

An object of the present invention is to improve safety of unsafe actions in a vehicle.

An aspect of the object is to improve the safety for a reasonable low cost and low effort.

SUMMARY OF THE INVENTION

The objectives stated and other advantages of the invention are achieved by a system and a method. The present invention is characterised by providing an extra safety arrangement when discharge is allowed.

The invention relates to a discharging signalling system of at least one dispenser of a vehicle comprising an activation circuit arranged to discharge the dispenser wherein the system comprises indicator means arranged to indicate that dispensing is allowed, wherein the activation circuit comprises a first safety arrangement arranged to be activated when an indication from the indicator means is indicating that dispensing is allowed and characterised in that the activation circuit comprises a second safety arrangement arranged to be activated when an discharge of the dispenser is indicated.

In an embodiment the indicator means is a dynamic signal generator arranged to generate a dynamic signal when discharging is allowed.

The indicator means may in an embodiment further comprise a first static signal generator arranged to generate a static signal when sensors in the vehicle fulfill at least one predetermined requirement.

The system may comprise a processor arranged to generate a safety signal when the safety processor receives the static signal transmitted from the static signal generator and the dynamic signal.

Additionally, may the safety signal be configured to activate the first safety arrangement of the activation circuit as long as the safety signal is activated.

The safety processor may be arranged with a timer adapted to control the time length of the safety signal.

The system may in an embodiment further comprise a loop back from the activation circuit to the safety processor resetting the timer of the system when the activation circuit is activated. Thus, the activation may be performed again providing a dynamic number of activation times wherein the system is in a safe state between the activations.

Furthermore may the indicator means be arranged to indicate that discharging is allowed is arranged to simultaneously indicate discharging of the dispenser, such as a release button or the like.

The system may further comprise an activating processor, wherein the static safety signal is to be transferred into the activating processor, and the dynamic safety signal is to be transferred to the activating processor, wherein the activating processor is arranged to activate the activating circuit discharging of the dispenser when safety signal is true.

In an embodiment the activating processor is arranged to generate an activating signal arranged to activate the second safety arrangement of the activation circuit arranged to activate the discharge of the dispenser.

In addition, the activating processor may be arranged to execute a program of discharging dispensers generating a sequence of activation signals.

Furthermore the first safety arrangement may be a switch and the second safety arrangement may be a switch arranged to close the activating circuit when activated and thereby discharging the dispenser.

The invention furthermore discloses a method for discharging a dispenser in a dispensing system of a vehicle wherein the dispensing system comprises a power fed activating circuit comprising the steps of; indicating that discharging is allowed; activating a first safety arrangement of the activating circuit when it is indicated by a indication that discharging is allowed; and activating a second safety arrangement of the activating circuit when discharging is indicated, wherein the activating circuit (50) is closed and the dispenser is discharged.

In addition, the step of indicating that discharging is allowed may comprise generating a dynamic safety signal.

The step of indicating that discharging is allowed may in an embodiment further comprise the step of; fulfilling at least one requirement of a condition of the vehicle and generating a static safety signal.

In an embodiment the step of activating the first safety arrangement comprises generating a third safety signal in a safety processor of the system when the dynamic safety signal and the static signal are received at the safety processor, wherein the safety signal is activating the first safety arrangement.

The third safety signal may be activated over a certain time controlled by a timer in the safety processor, and wherein the timer is set off when the safety and the static signal is received at the safety processor.

Additionally, may the method further comprise the step of: reloading the timer when a discharge of the dispenser has been made.

Furthermore, may the indication of allowing a discharge also indicate an initiation of discharge of a dispenser generating an activation signal in a second processor when the static signal and the dynamic signal is received at the second processor, wherein the activation signal is activating the second safety arrangement of the activation circuit of the dispensing system.

The step of activating safety arrangements may comprise activating a safety switch in the activating circuit.

In an embodiment of the invention a time gap is established wherein discharging is allowed. The time gap is very short relative a complete mission/flight and the safety of the vehicle increased. The result of the embodiment is a minimisation of the time discharging is allowed, generated by the time gap. The time gap can be dynamically reloaded, minimizing the risk of being unintentional reloaded.

BRIEF DESCRIPTION OF THE DRAWINGS

The invention, together with further objectives and advantages thereof, may best be understood by reference to the following description taken in conjunction with the accompanying drawings in which.

DETAILED DESCRIPTION OF EMBODIMENTS OF THE PRESENT INVENTION

Figure 1:
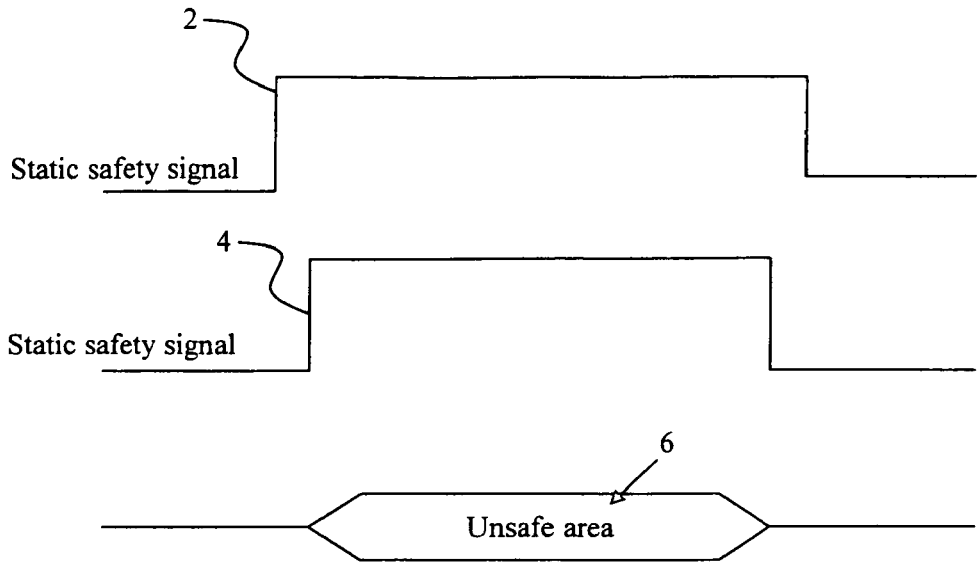
FIG. 1 (Prior art)
FIG. 1 shows a conventional signalling scheme known in prior art.

Embodiments of the present invention will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

The present invention is described below with reference to block diagrams and/or flowchart illustrations of methods, apparatus (systems) and/or computer program products according to embodiments of the invention. It is understood that several blocks of the block diagrams and/or flowchart illustrations, and combinations of blocks in the block diagrams and/or flowchart illustrations, can be implemented by computer program instructions. These computer program instructions may be provided to a processor of a general purpose computer, special purpose computer, and/or other programmable data processing apparatus to produce a machine, such that the instructions, which execute via the processor of the computer and/or other programmable data processing apparatus, create means for implementing the functions/acts specified in the block diagrams and/or flowchart block or blocks.

These computer program instructions may also be stored in a computer-readable memory that can direct a computer or other programmable data processing apparatus to function in a particular manner, such that the instructions stored in the computer-readable memory produce an article of manufacture including instructions which implement the function/act specified in the block diagrams and/or flowchart block or blocks.

The computer program instructions may also be loaded onto a computer or other programmable data processing apparatus to cause a series of operational steps to be performed on the computer or other programmable apparatus to produce a computer-implemented process such that the instructions which execute on the computer or other programmable apparatus provide steps for implementing the functions/acts specified in the block diagrams and/or flowchart block or blocks.

Accordingly, the present invention may be embodied in hardware and/or in software (including firmware, resident software, micro-code, etc.). Furthermore, the present invention may take the form of a computer program product on a computer-usable or computer-readable storage medium having computer-usable or computer-readable program code embodied in the medium for use by or in connection with an instruction execution system. In the context of this document, a computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Referring to FIG. 1 which discloses a prior art system wherein an overview of signals in a dispensing system is disclosed. In the conventional system a first static safety signal 2 is generated and a second safety signal 4 is generated at take off in order to avoid discharge on the ground. This results in an unsafe period of time during the entire flight and is disclosed as an unsafe area 6 in FIG. 1.

Figure 2:
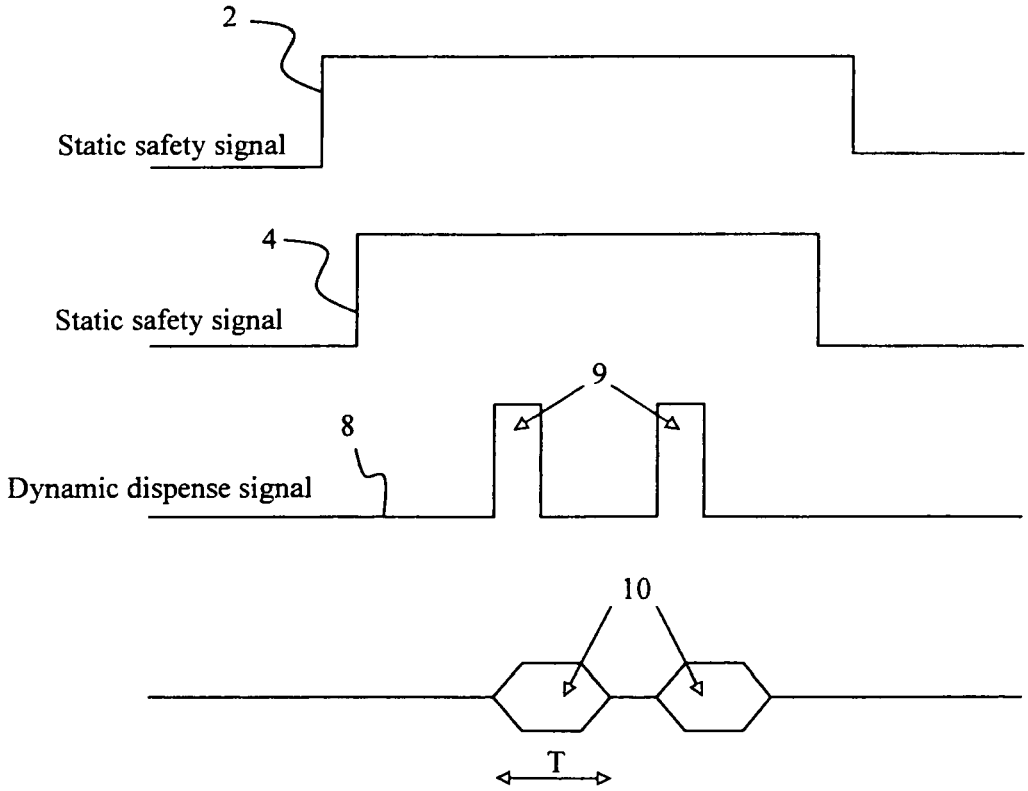
FIG. 2 shows a signalling scheme according to an embodiment of the invention.

Referring to FIG. 2, an embodiment of the signaling scheme of the present invention is shown. As mentioned in FIG. 1 a first 2 and a second 4 static safety signal is generated, but here a dynamic safety signal 8 is introduced. The dynamic safety signal 8 indicates that a timer of allowing discharging to be performed is started. During this time interval discharging is possible. A dynamic pulse 9 is initiated by the pilot or the like by pressing a discharge button or the like, and thereafter the discharge interval is timer controlled. In the illustrated example two pulses 9 on the dynamic safety signal is showed, every pulse generates a length of time, T, during which a discharge of a dispenser is possible. The dispensing system is only in an unsafe state during this time as denoted as 10 in FIG. 2. The unsafe areas 10 are controlled by classified firmware and hardware. The control function in hardware and firmware is very small making design effort small compared to achieved functionality. Using regular software functions requires all software to be classified since all software contained in a controller environment has to have equal safety classification. By implementing the smaller software/firmware part into a separate controlling functionality, high classification level can be achieved. The safety of the system is enhanced by providing an extra safety arrangement in the system that is merely activated when a dynamic intentional signal from the operator or the like is generated.

Figure 3:
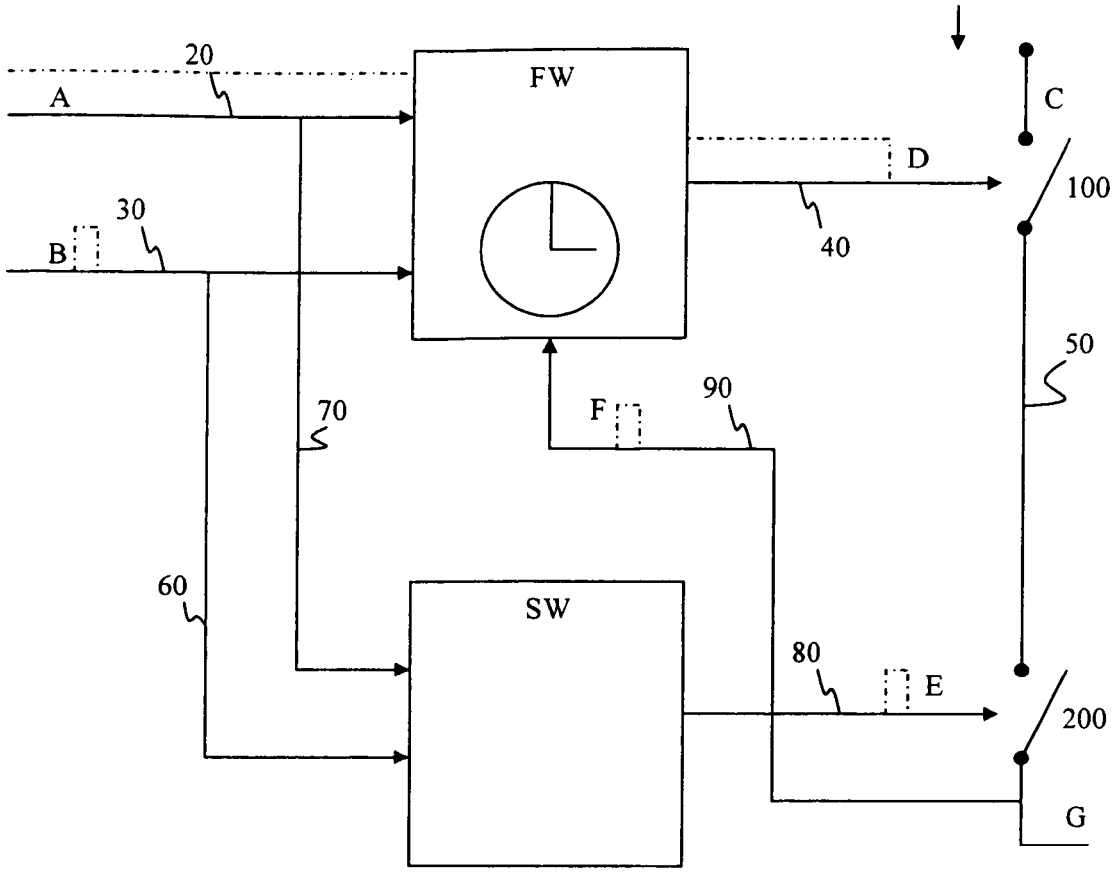
FIG. 3 shows a schematic overview of a signal flow according to an embodiment of the invention.

Referring to FIG. 3, a schematic electrical signal scheme of an embodiment of the invention is disclosed. Signal A is a static safety signal, initiated by static safety functions of the platform and transferred on line 20 to a processor FW. Signal B is a dynamic signal, which is the signal that is generated when the pilot or the like indicates a discharge, such as by pressing a discharge initiation button or the like, and that is fed on line 30 to the processor FW. When the static safety signal A and the dynamic safety signal B are set to true, e.g. an active "1", initiation of the discharge process can be performed. The signals A and B, being true, activates a signal D, transferring on line 40, that closes a switch 100 when being true; at the same time the signals set off/start a timer with a predetermined time T in block FW that controls the length of time the signal D should be activated. The switch 100 closes the circuit 50 enabling the power feed C to pass over the switch 100. The switch is kept in a connected state during the time, T, the signal D is true, i.e. the timer of block FW controls the time gap over which it is possible to discharge a dispenser as long as the static safety signal is true.

In the illustrated example in FIG. 3, block SW is generating each discharging signal, while the block FW is controlling the possibility of the actual initiation to occur i.e. a discharge of a dispenser. A discharging signal is denoted as E in FIG. 3. The discharging signal E activates and closes a second switch 200 enabling the power feed of the activating circuit 50 to pass to an electrical igniter G of the dispenser, resulting in an ignition of a flare of the like. As a result of the discharging pulse signal E a reload signal F is generated and transferred to the timer of block FW. The reload signal F is generated as a pulse from the discharging pulse signal E, i.e. when a signal E is generated on line 80 the switch 200 is closed and a pulse is generated to the electrical igniter G as well as a pulse F to block FW. The FW receives the pulse F and resets the timer function, resetting the timer function in FW enables the timer to run for the next received dynamic safety pulse 90.

When the time T of the timer has run out the switch 100 is disconnected and no ignition or reloading of the timer is possible. If the static safety signal A is deactivated, the signal D traveling on line 40 is also deactivated, resulting in that the reloading of the timer or discharging is not possible.

In an embodiment of the present invention the static safety signal, A, is also transferred on line 70 and the dynamic safety signal, B, is also transferred on line 60 to a second processor running low safety controlled SW. In the low safety controlled SW a second timer function is running that allows the discharging signal E to be forwarded or generated only when the actual dispense instants as received via data link from a system controller or loaded into the dispenser at maintenance level allows and the static safety signals are true.

Signal A origins from the aircraft or platform static safety functions such as weight off wheels, master arm or equal system safety function. Signal B origins from the aircraft or platform dynamic safety initiation signal such as a pilot dispense initiation button.

It should here be noted that the FW may be arranged to trigger the signal (D) of a certain length without a timer wherein the signal is arranged to allow the switch (100) to be activated over a time enough to allow the discharging of the dispenser or the block FW may be arranged to activate the safety signal continuously after the dynamic signal is received.

Figure 4:
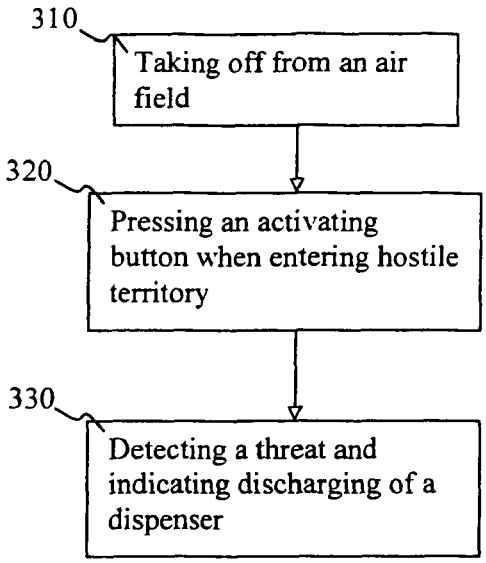
FIG. 4 is a flowchart of the operating of the system.
Figure 5:
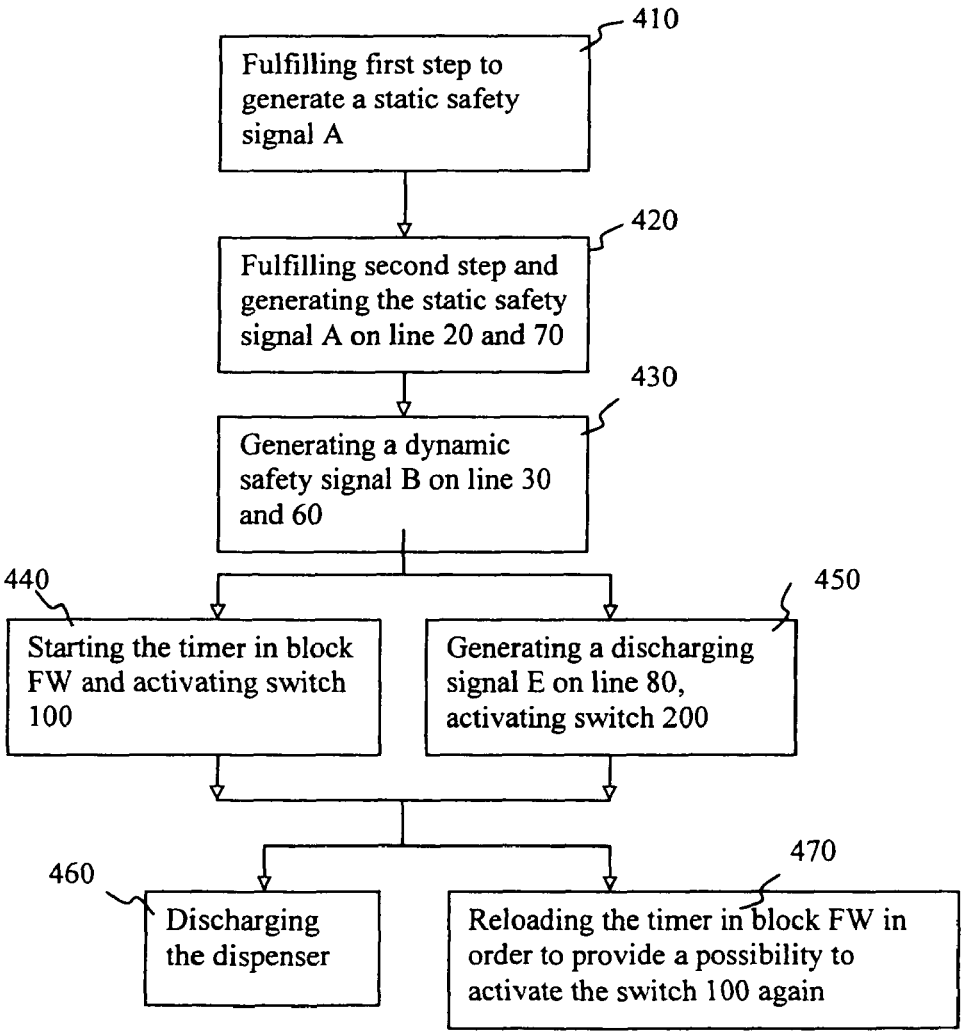
FIG. 5 is a block diagram of the system in FIG. 3.

The method according to an embodiment of the invention is illustrated, wherein the process steps taken by a pilot, a control system or the like, of the vehicle are shown as a flowchart in FIG. 4. The steps performed according to an embodiment of the invention in the dispensing system are shown in FIG. 5. The operation of the system will now be explained referring to FIGS. 3, 4 and 5. I should be noted that in the present embodiment the system needs to fulfill at least two requirements in order to generate a static safety signal.

In step 310 the plane takes off from an airfield or the like. This step is the first requirement that needs to be fulfilled in order to generate a static safety signal A by a signal generator in the signaling system of the plane, step 410. The signal generator may be in any known form and the first requirement may be reading that the aircraft is in a weight off wheels-condition, master arm is on or an equal system safety function.

In step 320 the vehicle travels into enemy territory or the like, and the operator of the system or the system itself using GPS, geographical information or the like to determine that vehicle is in enemy territory, indicates to the signaling system so that the signaling system is set to a ready state, i.e. dispenser ready state. This step is set to be a second requirement to generate the static safety signal A on line 20, and when this requirement is fulfilled the signal generator generates a static safety signal A on the line 20 and 70 as stated in step 420, initiated by the determination that dispensers may be used.

It should here be understood that the generation of the static safety signal A may be generated by a static signal indicating that the first requirement is fulfilled and a second static signal indicating that the second requirement is fulfilled, for example, by a switch function or the like.

In step 330 a threat, such as a missile approaching the vehicle or the like, is detected and the dispensing system is set to a dispensing state initiated by the pilot, i.e. generating the dynamic safety signal B on line 30 and 60, step 430.

The dynamic safety signal triggers the signaling system to start a timer, which has been set for a predetermined time, during which time T the dispensing system is armed, i.e. discharging a dispenser is allowed. In order to allow dispensing a switch 100 of the signaling system is activated by an activating signal D that is arranged to be active during the predetermined time set up in the timer, step 440.

The operator or the system indicates a release, discharge of a dispenser when a threat is detected. In an embodiment of the invention the dynamic signal B generated by pressing down the dispensing button not only activates signal D but also allows the generation of the unsafe action signal E, e.g. a discharging signal E, and as indicated by the operator the signaling system generates a discharging signal E arranged to activate a switch 200 of the signaling system, step 450.

It should here be understood that when the pilot indicates a release of a dispenser this may execute a program of discharging dispensers in a certain order with a certain delay, for example, a certain sequence of discharging multiple dispensers. The program may be transmitted on a data bus to the SW from a counter measure system and the program prompts the pilot to execute the discharging of dispenser.

A timer in SW may be set during which the SW should perform all the preprogrammed discharging of the dispensers.

Since the time interval of signal D has not run out yet the static signal D is still activating the switch 100 in a closed state and the unsafe action signal E activates the switch 200 resulting in that the activating circuit of the dispensing system is completed and the electrical igniter of the flare is triggered by the power from the activating circuit, step 460.

In step 470, each discharge generates a signal F raised from the activation of the switch 200 that is transferring along line 90. When the signal pulse F is received in the block FW the processor reloads the timer function, e.g. a timer flag is set back to 1, resulting in that when a dynamic safety signal and a static safety signal is received simultaneously a timer function is started counting down to zero from a predetermined start value. During the time it takes for the timer to reach zero the processor either continuously forwards the static safety signal or generates internally a signal activating the switch of the circuit.

If, however, the timer has ran out in FW, i.e. dispensing is not allowed, the switch 100 is deactivated and if a malfunction in the system results in that an indication of a release of a dispenser, for example, short circuit switch 200, no discharge is possible since the circuit is still broken by the deactivated switch 100. The discharge and thereby the reloading of the timer in FW is not allowed until a new indication from the pilot is provided.

Implementing the FW function into a system results in that the SW does not have to achieve high classification level, which would be very costly.

It should be understood that the dynamic signal may be separated from the discharging signal by implementing two indications from the operator or system, for example, two buttons, one safety button and one release button.

It should also be understood that the switches (100, 200) in the activating circuit may be, in a different embodiment, other safety arrangements such as two requirements that need to be fulfilled in a program arranged in a processor provided in the activation circuit or the like. And when these conditions are met the program generates a discharge signal on the activation circuit.

The foregoing has described the principles, preferred embodiments and modes of operation of the present invention. However, the invention should be regarded as illustrative rather than restrictive, and not as being limited to the particular embodiments discussed above. It should therefore be appreciated that variations may be made in those embodiments by those skilled in the art without departing from the scope of the present invention as defined by the following claims.

The invention claimed is:

1. A discharging signalling system of at least one dispenser of a vehicle, comprising:

an indicator arranged to indicate that dispensing is allowed, wherein the indicator comprises a dynamic signal generator arranged to generate a dynamic safety signal when discharging is allowed, wherein the indicator further comprises a first static signal generator arranged to generate a static safety signal when sensors in the vehicle fulfill at least one predetermined requirement, an activation circuit arranged to discharge the dispenser, the activation circuit comprising a first safety arrangement arranged to be activated when an indication from the indicator indicates that dispensing is allowed, the activation circuit further comprising a second safety arrangement arranged to be activated when a discharge of the dispenser is indicated, and a safety processor arranged to generate a safety signal when the safety processor receives the static signal transmitted from the static signal generator and the dynamic signal, wherein the safety signal is configured to activate the first safety arrangement of the activation circuit as long as the safety signal is activated, and wherein the safety processor comprises a timer adapted to control the time length of the safety signal.

2. The system according to claim 1, further comprising:

a loop back from the activation circuit to the safety processor resetting the timer of the system when the activation circuit is activated.

3. The system according to claim 1, wherein the indicator is arranged to simultaneously indicate discharging of the dispenser.

4. The system according to claim 3, wherein the indicator comprises a release button.

5. The signalling system according to claim 1, further comprising:

an activating processor, wherein the static safety signal is to be transferred into the activating processor, and the dynamic safety signal is to be transferred to the activating processor, wherein the activating processor is arranged to activate the activating circuit discharging of the dispenser when safety signal is true.

6. The signalling system according to claim 5, wherein the activating processor is arranged to generate an activating signal arranged to activate the second safety arrangement of the activation circuit arranged to activate the discharge of the dispenser.

7. The signalling system according to claim 5, wherein the activating processor is arranged to execute a program of discharging dispensers generating a sequence of activation signals.

8. The signalling system according to claim 1, wherein the first safety arrangement comprises a switch and the second safety arrangement comprises a switch arranged to close the activating circuit when activated and thereby discharging the dispenser.

9. A method for discharging a dispenser in a dispensing system of a vehicle wherein the dispensing system comprises a power fed activating circuit, the method comprising:

indicating that discharging is allowed, wherein indicating that discharging is allowed comprises generating a dynamic safety signal, fulfilling at least one requirement of a condition of the vehicle, and generating a static safety signal;

activating a first safety arrangement of the activating circuit when it is indicated by a indication that discharging is allowed, wherein activating the first safety arrangement comprises generating a third safety signal in a safety processor of the system when the dynamic safety signal and the static signal are received at the safety processor, wherein the safety signal activates the first safety arrangement, and wherein the third safety signal is activated over a time controlled by a timer in the safety processor, and wherein the timer is set off when the safety and the static signal is received at the safety processor; and activating a second safety arrangement of the activating circuit when discharging is indicated, wherein the activating circuit is closed and the dispenser is discharged.

10. The method according to claim 9, further comprising:

reloading the timer when a discharge of the dispenser has been made.

11. The method according to claim 9, wherein the indication of allowing a discharge also indicates an initiation of discharge of a dispenser generating an activation signal in a second processor when the static safety signal and the dynamic safety signal are received at the second processor, wherein the activation signal is activating the second safety arrangement of the activation circuit of the dispensing system.

12. The method according to claim 9, wherein activating safety arrangements comprises activating a safety switch in the activating circuit.

* * * * *